US011412804B1

(12) United States Patent
Svendsen et al.

(10) Patent No.: US 11,412,804 B1
(45) **Date of Patent: *Aug. 16, 2022**

(54) FISHING HAT

(71) Applicant: FiveFifteen, LLC, Nashville, TN (US)

(72) Inventors: Christian Svendsen, Nashville, TN (US); Jon Elliot, Nashville, TN (US); Erik Svendsen, Provo, UT (US)

(73) Assignee: FiveFifteen, LLC, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/014,690

(22) Filed: Sep. 8, 2020

Related U.S. Application Data

(63) Continuation of application No. 15/963,072, filed on Apr. 25, 2018, now Pat. No. 10,765,163.

(51) Int. Cl.

| | |
|---|---|
| ***A42B 1/24*** | (2021.01) |
| ***A42B 1/0181*** | (2021.01) |
| *A42B 1/08* | (2006.01) |
| *A45F 5/02* | (2006.01) |

(52) U.S. Cl.
CPC ..... *A42B 1/24* (2013.01); *A42B 1/0181* (2021.01); *A41D 2600/00* (2013.01); *A41D 2600/106* (2013.01); *A45F 2005/023* (2013.01)

(58) Field of Classification Search
CPC ..... A01K 97/06; A01K 97/00; A01K 99/00; A42B 1/24; A42B 1/062; A42B 1/004; A42B 1/205; A42B 1/241; A42B 1/006; A42B 1/247; A42B 1/064; A42B 3/04; A42B 1/244; A42B 3/0406; A42B 3/22; A63B 57/207; A63B 57/353; A63B 2209/08; A63B 2209/10; A63B 57/203; A63B 57/35; A63B 71/10; A45F 5/02; A41D 27/08; A41D 13/0012; A41D 2600/106; A41D 2600/10; G02C 3/02; A43C 9/02
See application file for complete search history.

(56) References Cited

U.S. PATENT DOCUMENTS

| | | | | | |
|---|---|---|---|---|---|
| 725,524 | A | * | 4/1903 | Wetmore | A42B 1/24 2/209.13 |
| 1,133,542 | A | * | 3/1915 | Deal | A01K 97/06 43/57.1 |
| 1,231,165 | A | * | 6/1917 | Jay | A01K 97/06 43/57.1 |
| 1,499,858 | A | * | 7/1924 | Davis | A01K 97/06 43/57.1 |
| 1,787,568 | A | * | 1/1931 | Cooke | A01K 97/06 43/57.2 |
| 2,222,096 | A | * | 11/1940 | Walthour, Jr. | A01K 97/06 43/57.1 |
| 2,235,914 | A | * | 3/1941 | Beck | A01K 97/06 43/57.1 |

(Continued)

*Primary Examiner* — Robert H Muromoto, Jr.
(74) *Attorney, Agent, or Firm* — Waller Lansden Dortch & Davis, LLP; Christopher T. McNeill; Andre J. Bahou

(57) ABSTRACT

An apparatus may include a hat. The hat may include a crown. The hat may include a bill coupled to the crown. The bill may protrude away from the crown. The apparatus may include a strip of pliant, resilient material. The strip may be coupled to the hat. The pliant, resilient material of the strip may include a high-density, closed-cell foam. The strip may be coupled to the bill of the hat.

18 Claims, 8 Drawing Sheets

(56) References Cited

U.S. PATENT DOCUMENTS 2,481,586 A * 9/1949 Gregory ..... A01K 97/06 43/57.1
2,509,490 A * 5/1950 Fecteau ..... A01K 97/06 43/57.1
2,597,601 A * 5/1952 Sherman ..... A42B 1/24 43/57.1
2,629,963 A * 2/1953 Youker ..... A01K 97/06 43/57.1
2,764,839 A * 10/1956 Wylie ..... A01K 97/06 43/57.1
2,769,272 A * 11/1956 Goldman ..... A42B 1/24 446/27
2,795,890 A * 6/1957 Metsker ..... A01K 97/06 43/57.1
2,813,368 A * 11/1957 Knowles ..... A01K 97/06 43/57.1
2,913,850 A * 11/1959 George ..... A01K 97/06 43/57.1
3,121,970 A * 2/1964 Oakes ..... A01K 97/06 43/57.1
3,122,854 A * 3/1964 Boertlein, Sr. ..... A01K 97/06 43/57.1
3,225,912 A * 12/1965 Bryant ..... A01K 97/00 206/449
3,546,709 A * 12/1970 Cross ..... A42B 1/24 43/57.1
3,769,741 A * 11/1973 Hessler ..... A01K 97/06 43/57.1
4,703,581 A * 11/1987 Whittier ..... A01K 97/06 43/57.1
4,944,111 A 7/1990 Daniel
4,970,821 A * 11/1990 Young ..... A01K 97/06 150/113
4,982,449 A * 1/1991 Finkelstein ..... A42B 1/062 2/195.6
5,337,511 A * 8/1994 Ashbaugh ..... A01K 97/06 206/315.11
5,454,185 A * 10/1995 Love ..... A01K 97/06 206/315.11
5,581,813 A * 12/1996 Henschel ..... A42B 1/248 2/195.1
5,740,557 A * 4/1998 Reid ..... A42B 1/248 2/195.1
5,862,523 A * 1/1999 Proctor ..... A42B 1/064 2/171
5,898,946 A * 5/1999 Keating ..... A42B 1/24 2/209.13
5,983,556 A 11/1999 Zaloga
5,996,116 A * 12/1999 Tate ..... A01K 97/06 2/12
6,163,889 A * 12/2000 Tate ..... A01K 97/06 2/209.13
6,170,088 B1 * 1/2001 Tate ..... A01K 97/06 2/209.13
6,694,526 B1 * 2/2004 Tate ..... A42B 1/24 2/209.12
6,763,163 B1 7/2004 Ford
6,763,632 B1 7/2004 Exby
6,782,654 B1 * 8/2004 Borchardt ..... A01K 97/06 211/13.1
6,966,851 B1 * 11/2005 England ..... A42B 1/24 473/406
7,140,047 B2 * 11/2006 Kronenberger ..... A42B 1/24 2/209.13
7,360,334 B2 * 4/2008 Christiansen ..... A01K 77/00 2/94
D578,741 S * 10/2008 Hernandez ..... D2/891
7,461,764 B2 * 12/2008 Thompson ..... A42B 1/002 2/209.13
7,640,601 B2 * 1/2010 Lee ..... A42B 1/063 2/195.1
7,761,928 B2 * 7/2010 Wang ..... A42B 1/247 2/10
7,979,920 B2 * 7/2011 Gilman ..... G02C 3/02 2/195.1
8,235,262 B1 * 8/2012 Sakdol ..... A42B 3/04 224/183
8,763,163 B1 * 7/2014 Johns ..... A42B 1/004 2/195.1
9,179,726 B2 * 11/2015 Hanover ..... A42B 1/24
9,185,944 B2 * 11/2015 Zhen ..... A42B 1/24
9,320,267 B2 * 4/2016 Smith ..... A01K 97/06
10,080,938 B2 * 9/2018 Kias ..... A42B 1/241
10,357,072 B2 * 7/2019 Chong ..... A42B 3/32
10,362,827 B2 * 7/2019 Bryan ..... A42B 3/18
10,765,163 B2 * 9/2020 Svendsen ..... A42B 1/24
2002/0034992 A1 * 3/2002 Tate ..... A63B 57/353 473/406
2002/0148032 A1 * 10/2002 Basson ..... A42B 3/042 2/422
2002/0162260 A1 * 11/2002 Tate ..... G09F 23/00 40/630
2004/0117894 A1 * 6/2004 Kuo ..... A42B 1/248 2/209.13
2006/0048441 A1 3/2006 Sharff
2006/0107447 A1 * 5/2006 Augustine ..... A43B 3/0078 2/455
2006/0174398 A1 * 8/2006 Proctor ..... A42B 1/062 2/209.13
2006/0230497 A1 * 10/2006 Thompson ..... A42B 1/002 2/175.5
2007/0028361 A1 * 2/2007 Ashy ..... A42B 1/248 2/209.13
2007/0118977 A1 * 5/2007 Brier, Jr. ..... A41F 9/00 2/338
2008/0066215 A1 * 3/2008 Thompson ..... A42B 1/002 2/175.5
2009/0119819 A1 * 5/2009 Thompson ..... A42B 1/002 2/209.13
2009/0265837 A1 * 10/2009 Cunliffe ..... A42B 1/24 2/244
2009/0288331 A1 * 11/2009 Moyer ..... A01K 97/06 43/57.1
2010/0122401 A1 * 5/2010 Thompson ..... A42B 1/24 2/209.13
2010/0325780 A1 * 12/2010 Scanlan ..... A42B 1/248 2/209.13
2011/0078843 A1 * 4/2011 Kennedy ..... A42B 1/241 2/209.13
2011/0119800 A1 * 5/2011 Garrido ..... A41D 13/0012 2/2.15
2012/0233904 A1 * 9/2012 Fox ..... A01K 97/06 43/4
2013/0047317 A1 * 2/2013 Hanover ..... A42B 1/24 2/209.12
2013/0125292 A1 * 5/2013 Weaver ..... A42B 1/006 2/209.13
2013/0167286 A1 * 7/2013 Hudson ..... A41D 1/04 2/102
2014/0026297 A1 * 1/2014 Enes ..... A01K 97/00 2/410
2014/0245521 A1 * 9/2014 Johns ..... A42B 1/004 2/209.13
2015/0047249 A1 * 2/2015 Smith ..... A01K 97/06 43/54.1
2015/0082667 A1 * 3/2015 Augustine ..... A43B 3/0078 36/136
2016/0021963 A1 * 1/2016 Johns ..... A42B 1/004 2/209.11
2016/0205913 A1 * 7/2016 Aston ..... A01K 97/06
2016/0316841 A1 * 11/2016 Melnyk ..... A42B 1/002
2017/0325440 A1 * 11/2017 Montano ..... A45F 5/02
2018/0042209 A1 * 2/2018 Aston ..... A01K 97/06
2018/0341114 A1 * 11/2018 Staton ..... G02B 27/0176

* cited by examiner

FISHING HAT

CROSS-REFERENCES TO RELATED APPLICATIONS

This application is a continuation of U.S. patent application Ser. No. 15/963,072 filed on Apr. 25, 2018 entitled "Fishing Hat" (now U.S. Pat. No. 10,765,163 issued on Sep. 8, 2020), which is hereby incorporated by reference in its entirety.

FIELD

This invention relates to hats and more particularly relates to fishing hats.

BACKGROUND

When people go fishing, they use a variety of equipment, such as lures, jigs, hooks, and the like. Fishers need convenient access to this equipment. However, retrieving the equipment can be difficult during fishing. For example, a fisher may be standing in the middle of a river and his or her tackle box may be on the shore of the river, and the fisher may need a new hook, fly, or the like. In another example, the fisher may be holding other fishing equipment and, thus, have limited use of his or her hands. Thus, a more convenient way of holding fishing gear is needed.

SUMMARY

An apparatus is disclosed. In one embodiment, the apparatus may include a hat. The hat may include a crown. The hat may include a bill coupled to the crown. The bill may protrude away from the crown. The apparatus may include a strip of pliant, resilient material. The strip may be coupled to the hat. In some embodiments, the pliant, resilient material of the strip may include a high-density, closed-cell foam. In one embodiment, the strip may be coupled to the bill of the hat.

An apparatus is disclosed. In one embodiment, the apparatus may include a hat. The hat may include a crown. The hat may include a bill. The bill may be coupled to the crown. The bill may protrude away from the crown. The apparatus may include a means for coupling a fishing hook. The means for coupling may be disposed on the hat. In one embodiment, the means for coupling may be disposed on the bill of the hat.

A hat is disclosed. In one embodiment, that hat may include a crown. The hat may include a bill coupled to the crown. The bill may protrude away from the crown. The hat may include a strip of high-density, closed-cell foam. The strip may be integrally coupled to a non-center portion of the bill.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1:
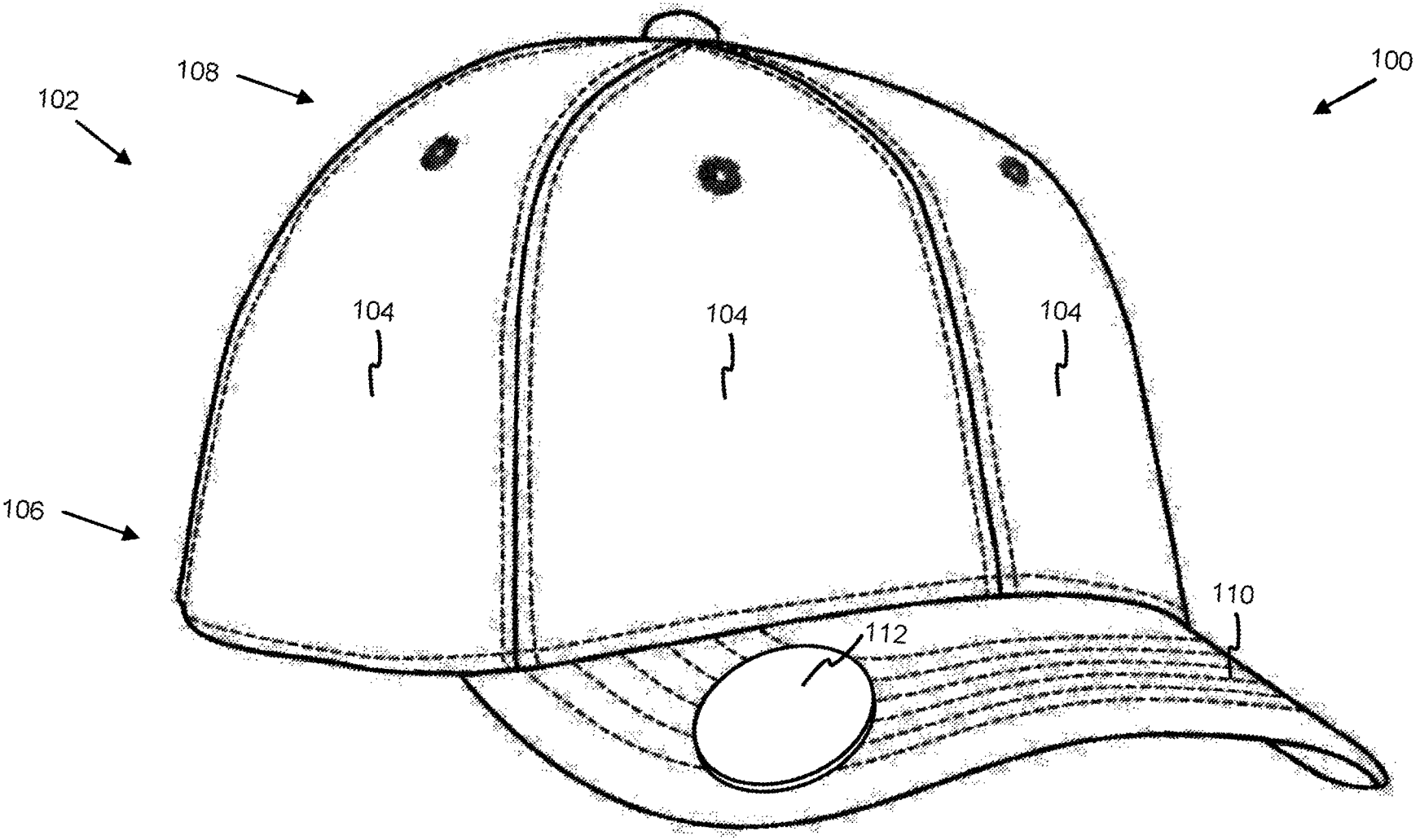
FIG. 1 is a perspective view illustrating one embodiment of a fishing hat apparatus.

Reference throughout this specification to "one embodiment," "an embodiment," "some embodiments," or similar language means that a particular feature, structure, or characteristic described in connection with the embodiment is included in at least one embodiment. Thus, appearances of the phrases "in one embodiment," "in an embodiment," "in another embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive or mutually inclusive, unless expressly specified otherwise.

The terms "a," "an," and "the" also refer to "one or more" unless expressly specified otherwise. The terms "first," "second," "third," and the like" do not imply that any or all of the items are mutually exclusive or mutually inclusive, or that the items include any certain order. The term "based on" includes in its meaning "based on, at least in part" and "based only on" unless expressly specified otherwise. Also, when discussing items and referring to items as "a portion," "a section," "a part," or the like, the portion, section, part, or the like of the item may include the entire item unless expressly specified otherwise. The terms "above," "below," "side," "upper," "lower," or the like are used for ease of explanation in reference to items discussed herein and do not necessarily indicate an absolute position unless expressly specified otherwise.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The one or more schematic flow chart diagrams that may be included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIG. 1 depicts one embodiment of an apparatus 100. In one embodiment, the apparatus 100 may include a hat. The hat may include a crown 102. The crown 102 may include one or more pieces of material that form a dome-like shape and may be adapted to fit over the head of a person. For example, in one embodiment, the crown 102 may include one or more panels 104 coupled together. In some embodiments, a panel 104 may include a piece of material. In one embodiment, a panel 104 may include a mesh. The crown 102 may include a lower portion 106. The lower portion 106 may include a portion of the crown 102 that is closer to an opening of the dome-like shape. The crown 102 may include an upper portion 108. The upper portion 108 may be disposed distal to the lower portion 106. In some embodiments, the crown 102 may include an adjuster to accommodate different sizes of heads. The adjuster may include a band that may snap into one or more positions with another band, a belt, a flexible opening of the lower portion 106, or the like.

In some embodiments, the hat of the apparatus 100 may include a bill 110. The bill 110 may be coupled to the crown 102. For example, as depicted in FIG. 1, the bill 110 may couple to the crown 102 at the lower portion 106 of the crown 102. In another embodiment, the bill 110 may couple to the crown 102 at the upper portion 108 of the crown 102 or at a middle portion of the crown 102. The bill 110 may protrude away from the crown 102. The bill 110 protruding away from the crown 102 may include the bill 110 protruding perpendicular to the crown 102. In one embodiment, the bill 110 may protrude away from the crown 102 at an incline. The bill 110 may include a resilient, semi-rigid material. The bill 110 may include a curve. In some embodiments, the bill 110 may include a flat, horizontal plane. The bill 110 may couple to the crown 102 around the length of the lower portion 106 of the crown 102, for example, as with a safari hat. In some embodiments, the bill 110 may couple to a portion of the crown 102 less than the length of the lower portion 106 of the crown 102, for example, as with a baseball cap and as depicted in FIG. 1.

In one embodiment, the apparatus 100 may include a strip 112 of material. The strip 112 may be coupled to the hat. The material may include a pliant, resilient material. The material may include a material that may releasably couple a fishing hook, fly, lure, or the like to material. For example, the material may include a material into which a person can insert a hook and remove the hook. The material may include a polymer that can releasably engage the hook. In one embodiment, the material may include a high density foam. The material may include a closed-cell foam such as an ethylene-vinyl acetate (EVA) foam or a polyethylene foam. The material may include neoprene, polyurethane, or another polymeric foam. The foam may include a non-absorbent foam or a water-resistant foam. The material may include wool. The material may include cork.

In some embodiments, the strip 112 may be coupled to the bill 110. In one embodiment, the strip 112 being coupled to the bill 110 may include the strip 112 being sewn to the bill 110. The strip 112 being couple to the bill 110 may include an adhesive coupling the strip 112 to the bill 110, or the like. The adhesive may include an adhesive designed to selectively couple the strip 112 to the bill 110 or an adhesive designed to couple the strip 112 to the bill 110 permanently.

The strip 112 being coupled to the bill 110 may include the strip 112 being integrated into the bill 110. The strip 112 being integrated into the bill 110 may include a portion of the strip 112 being inserted into the bill 110. The strip 112 being integrated into the bill 110 may include a portion of the bill 110 being inserted into the strip 112. In some embodiments, the strip 112 may selectively couple to the bill 110. This may allow a wearer to replace the strip 112 with a different strip 112.

Figure 2A:
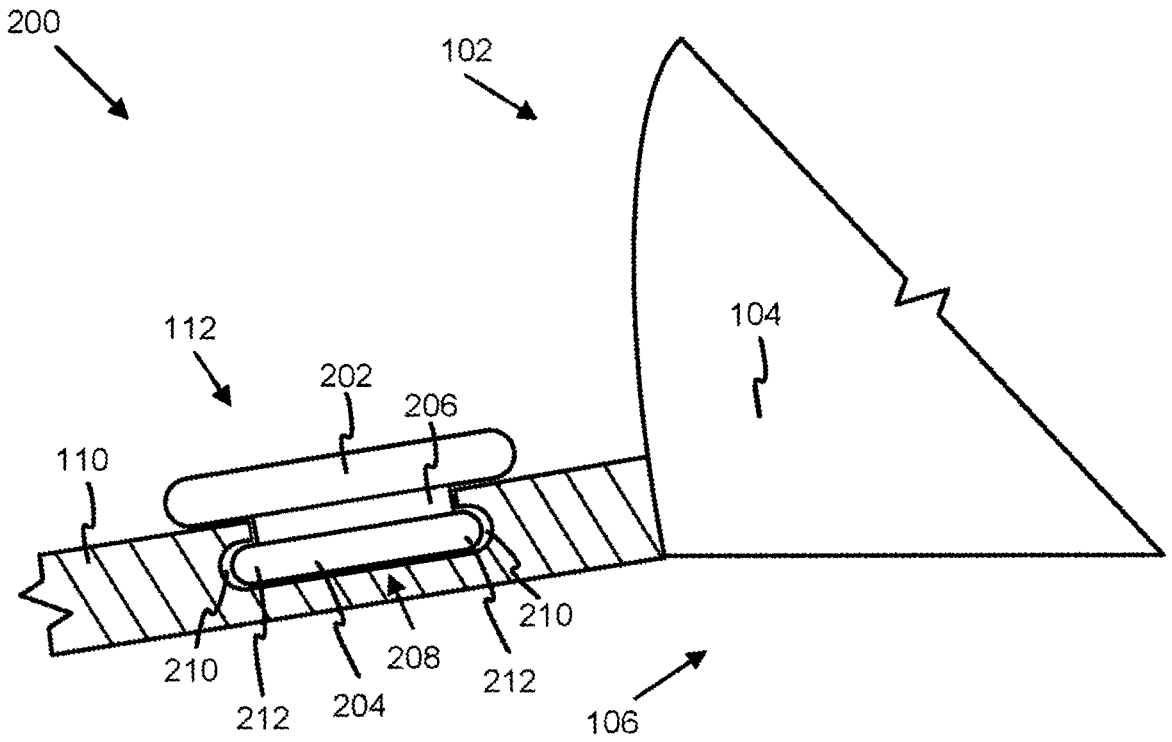
FIG. 2A is a cut away side view illustrating one embodiment of a fishing hat apparatus.

FIG. 2A depicts one embodiment of an apparatus 200. The apparatus 200 may include features similar to those of the apparatus 100, such as the crown 102, one or more panels 104, the lower portion 106 of the crown 102, the bill 110, and the strip 112 as explained above in relation to the apparatus 100. In one embodiment, the strip 112 may include an upper portion 202, a lower portion 204, and a connecting portion 206. The connecting portion 206 may couple the upper portion 202 to the lower portion 204. In some embodiments, the upper portion 202, lower portion 204, and connecting portion 206 may include being formed of an integral material. In some embodiments, the upper portion 202, lower portion 204, or connecting portion 206 may include different materials or may include being coupled together from separate parts. For example, in some embodiments, the upper portion 202 may include a foam, as explained above, and the lower portion 204 or the connecting portion 206 may include a plastic, vinyl, or the like.

Figure 2B:
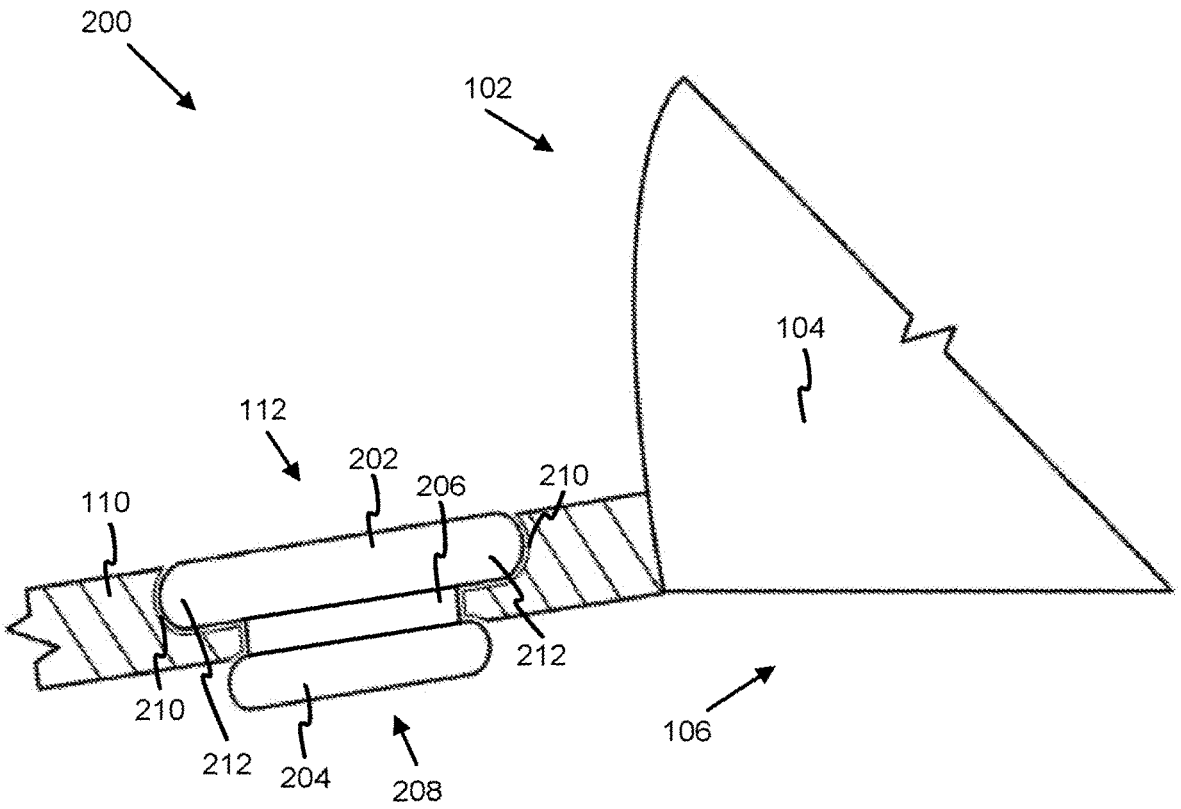
FIG. 2B is a cut away side view illustrating one embodiment of a fishing hat apparatus.

In one embodiment, the strip 112 being coupled to the bill 110 may include the bill 110 including an aperture 208. The aperture 208 may include an indent, hole, pocket, depression, or the like and a portion of the strip 112 may be adapted to fit into the aperture 208. For example, as shown in FIG. 2B, the aperture 208 may include a chamber 210 that may extend away from the opening aperture 208. The lower portion 204 of the strip 112 may include a flange 212. The flange 212 may be adapted to insert into the chamber 210 and couple the strip 112 to the bill 110. The upper portion 202 of the strip 112 may fit against an upper side of the bill 110 and may rest above the bill 110.

FIG. 2B depicts one embodiment of an apparatus 200. The apparatus 200 may include features similar to those of the apparatus 100, such as the crown 102, one or more panels 104, the lower portion 106 of the crown 102, the bill 110, and the strip 112 as explained above in relation to the apparatus 100. The bill 110 may include an aperture 208. The aperture 208 may be similar to the aperture 208 as explained above in relation to FIG. 2A. The aperture 208 may extend through the width bill 110 as shown in FIG. 2B. The strip 112 may include an upper portion 202, lower portion 204, and connecting portion 206 similar to those portions as explained above.

In one embodiment, the upper portion 202 may include the flange 212. The flange 212 may be adapted to insert into the chamber 210 and couple the strip 112 to the bill 110. The chamber 210 may be positioned such that the top of the upper portion 202 is substantially flush with the upper side of the bill 110. The upper portion 202 being substantially flush with the upper side of the bill 110 may allow the bill 110 to appear as a uniform construction or may allow the strip 112 to have a lower profile on the bill 110. The lower portion 204 may extend away from the lower side of the bill 110. The lower portion 204 may include a flange similar to the flange 208 of the lower portion 204 as explained above in relation to FIG. 2A. The flange of the lower portion 204 may couple the strip 112 to the bill 110.

Figure 2C:
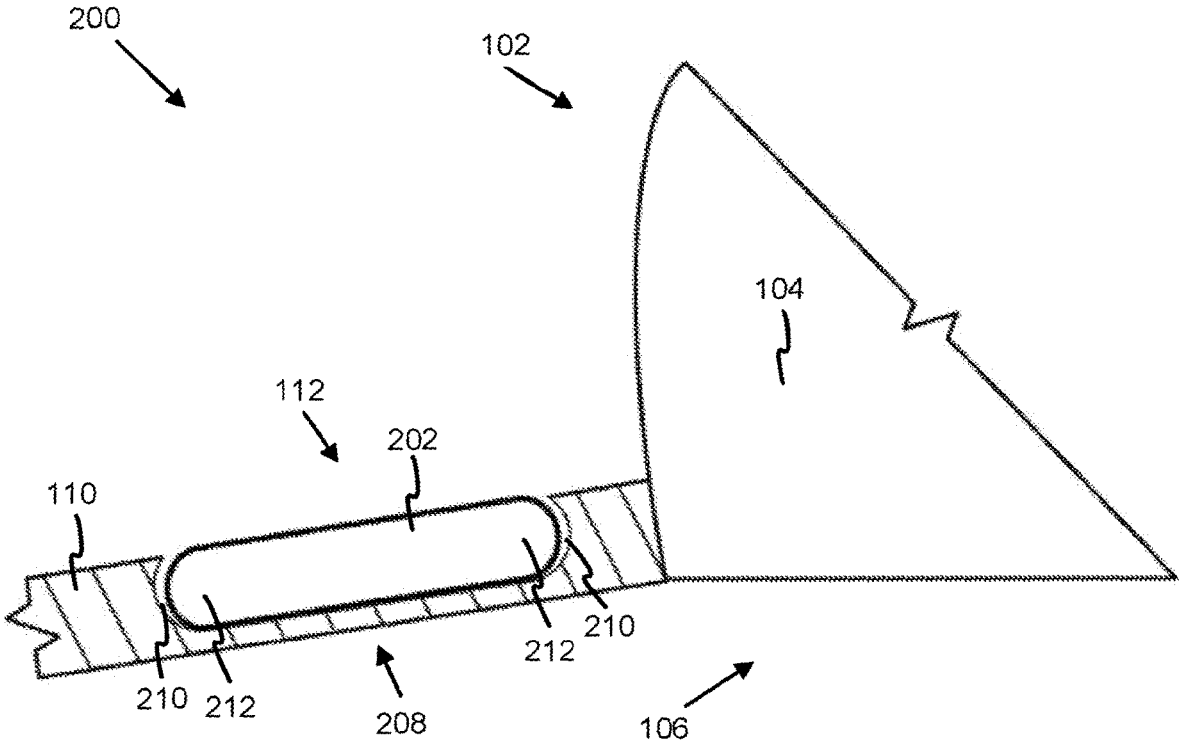
FIG. 2C is a cut away side view illustrating one embodiment of a fishing hat apparatus.

FIG. 2C depicts one embodiment of an apparatus 200. The apparatus 200 may include features similar to those of the apparatus 100, such as the crown 102, one or more panels 104, the lower portion 106 of the crown 102, the bill 110, and the strip 112 as explained above in relation to the apparatus 100. The bill 110 may include an aperture 208. The aperture 208 may be similar to the aperture 208 and chamber 210 as explained above in relation to FIG. 2A or FIG. 2B. In one embodiment, the strip 112 may include the upper portion 202. The upper portion 202 may include a flange 212 similar to the flange 212 of the upper portion 202 as explained in relation to FIG. 2B. The flange 212 may be adapted to insert into the chamber 210 and couple the strip 112 to the bill 110. The chamber 210 may be positioned such that the top of the upper portion 202 is substantially flush with the upper side of the bill 110.

In some embodiments, the strip 112 may be disposed on an underside of the bill 110. The strip 112 being disposed on the underside of the bill 110 may protect the strip 112, a hook, a lure, or the like from rain or the like. In one embodiment, the strip 112 being disposed on an underside of the bill 110 may include a portion of the strip 112 being disposed on the underside of the bill 110 as explained above in relation to FIG. 2B. In one embodiment, the strip 112 being disposed on the underside of the bill 110 may include the strip 112 being disposed only on the underside of the bill 110.

It should be noted that the elements of FIG. 2A, FIG. 2B, and FIG. 2C are illustrative only and are not to scale. Furthermore, in some embodiments, the strip 112 may not include a connecting portion 206 and the upper portion 202 may couple to the lower portion 204. In some embodiments, the strip 112 may couple to other parts of the apparatus 200, such as the crown 102. The strip 112 may couple to other parts of the apparatus 200 in a similar manner to coupling to the bill 110.

Figure 3:
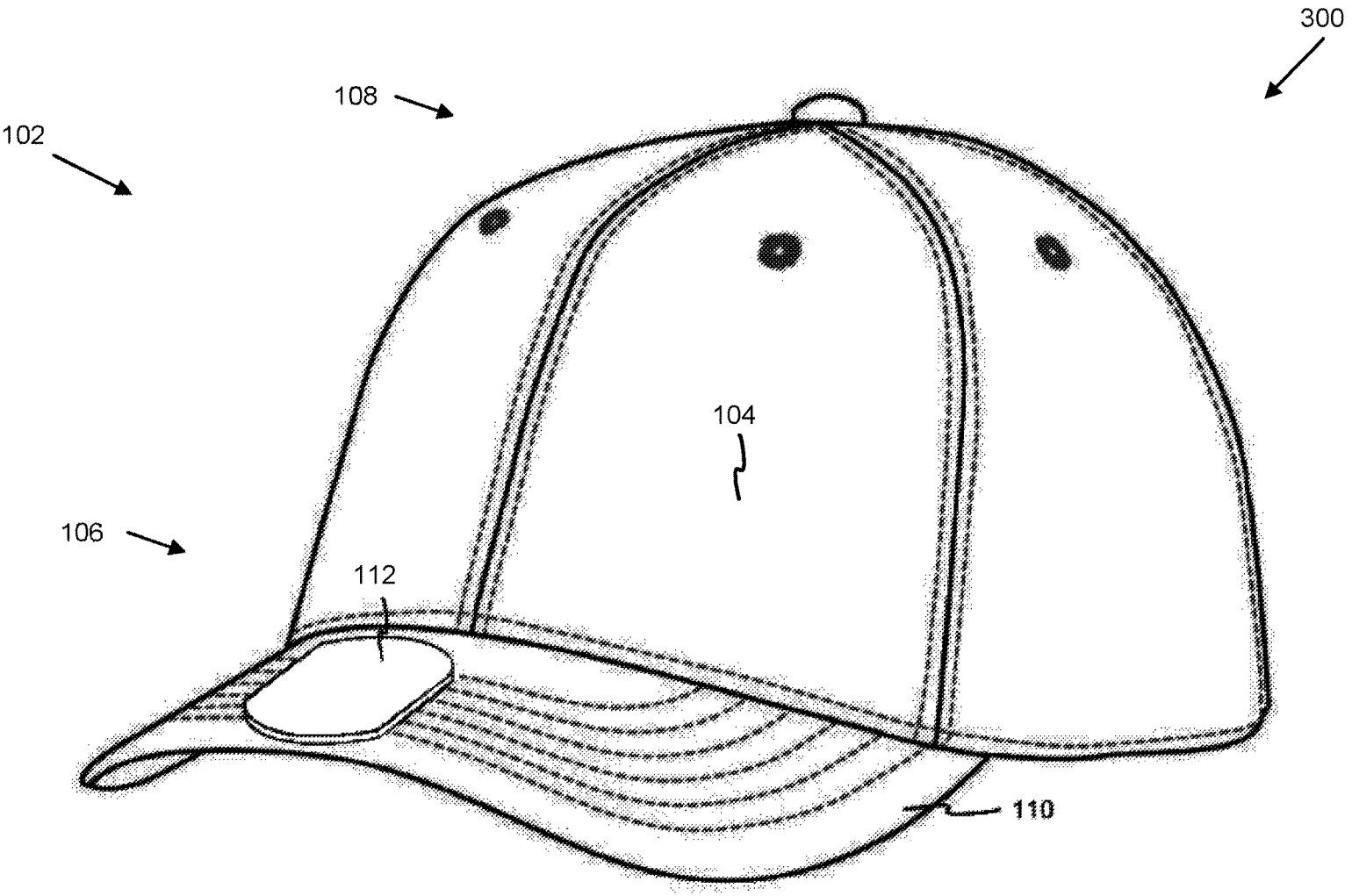
FIG. 3 is a perspective view illustrating one embodiment of a fishing hat apparatus.

FIG. 3 depicts one embodiment of an apparatus 300. The apparatus 300 may include features similar to those of the apparatus 100 or the apparatus 200. In one embodiment, the strip 112 may include a variety of shapes. In one embodiment, the strip 112 may include a circular shape. For example, as depicted in FIG. 1, the strip 112 may include the strip 112 and may include a circular shape. In another embodiment, the strip 112 may include a rectangular shape. For example, as depicted in FIG. 3, the strip 112 may include a rectangular shape. The rectangular shape may include some straight edges and some rounded edges. The straight edges may be disposed opposite each other and the rounded edges may be disposed opposite each other as shown in FIG. 3. In some embodiment, the strip 112 may include other shapes such as a square shape (which may be a subset of the rectangular shape), a rhombus shape, a shape with five or more sides. The shape may include irregular shapes. An irregular shape may include alphanumeric characters, an image, an outline of an image, a logo, or the like.

In some embodiments, the strip 112 may include one or more patterns. FIG. 4A depicts one embodiment of a strip 112. In one embodiment, a pattern may include one or more protrusions 402. A protrusion 402 may be coupled to a base of the strip 112 or may be integrally formed as part of the strip 112. A protrusion 402 may allow a fisher to insert a hook, fly, or the like into the protrusion 402. Having two or more protrusions 402 may allow a fisher to organize and separate hooks, flies, and the like. The one or more protrusions 402 may include a variety of shapes or a variety of positional arrangements on the strip 112. For example, as depicted in FIG. 4A, a protrusion 402 may include a circular shape and the one or more protrusions 402 may be arranged in an alternating grid arrangement. In one embodiment, a protrusion 402 may include a gradient disposed away from the base of the strip 112. For example, a gradient may include a mound shape, like a hill, or a pyramid shape. The gradient may have a circular base, rectangular base, or the like.

Figure 4C:
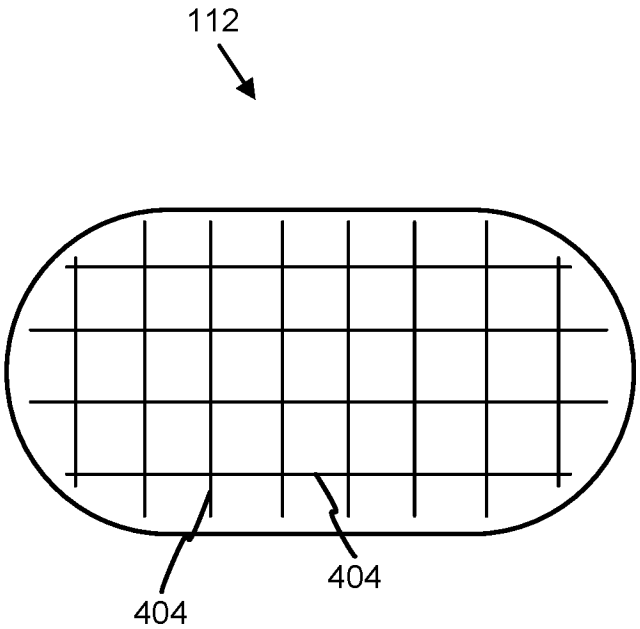
FIG. 4C is a top-down view illustrating one embodiment of a strip of material.
Figure 4B:
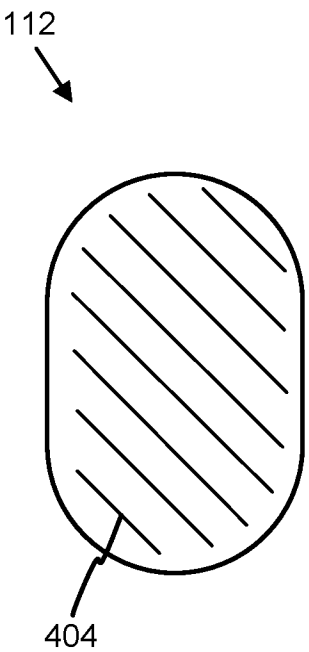
FIG. 4B is a top-down view illustrating one embodiment of a strip of material.
Figure 4A:
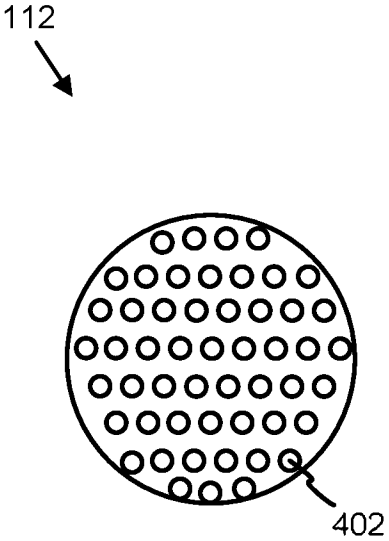
FIG. 4A is a top-down view illustrating one embodiment of a strip of material.

FIG. 4B and FIG. 4C each depict one embodiment of a strip 112. In one embodiment, a pattern may include one or more grooves 404. A groove 404 may be cut into the material of the strip 112. A groove may be integrally formed as part of the strip 112. The one or more grooves 404 may include a variety of widths or lengths. The one or more grooves may include a variety of positional arrangements on the strip 112. The one or more grooves may include a variety of shapes. For example, as shown in FIG. 4B, the one or more grooves 404 may be arranged in parallel and at an angle to the sides of the strip 112. As shown in FIG. 4C, the one or more grooves 404 may be arranged perpendicular to other grooves 404 and may be parallel to one or more sides of the strip 112. In one embodiment, the one or more grooves 404 may include a curve shape. In some embodiments, the one or more grooves 404 may not engage with a side of the strip 112. This may prevent a hook from slipping away from the strip 112 while inserting the hook into the strip 112, while the hook is coupled to the strip 112, or the like. In one embodiment, a groove 404 may allow a fisher to insert a hook into the groove 404, and the hook may not protrude away from the strip 112 as much as it would without the groove 404. This may allow the hook to have a lower profile while inserted into the strip 112.

Figure 5B:
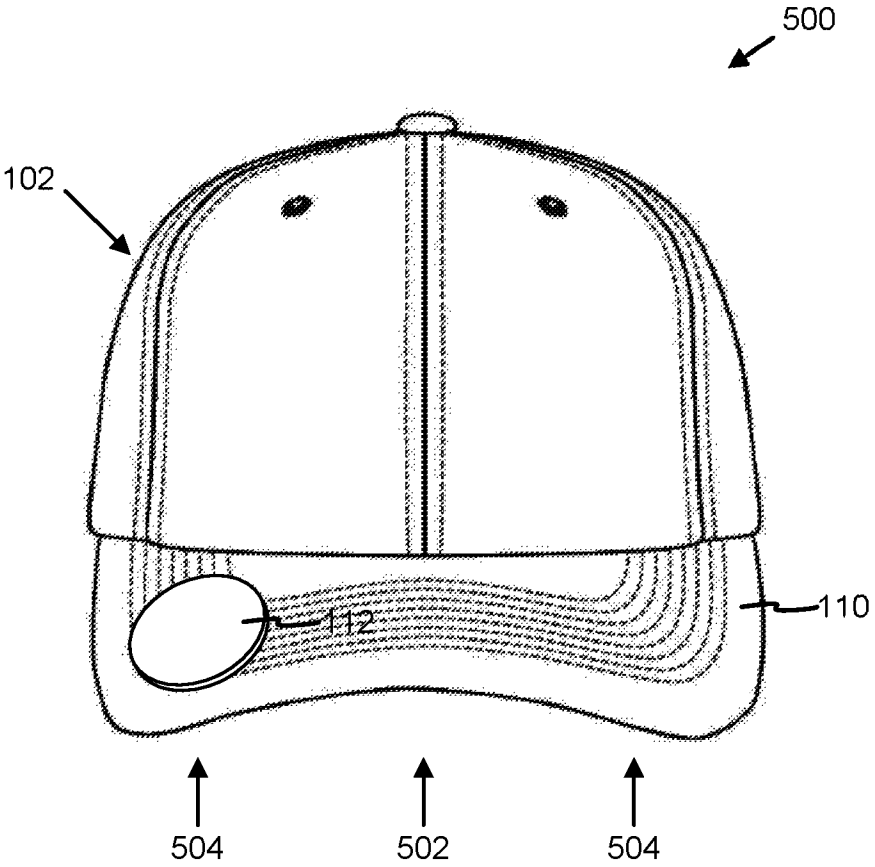
FIG. 5B is a front view illustrating one embodiment of a fishing hat apparatus.
Figure 5A:
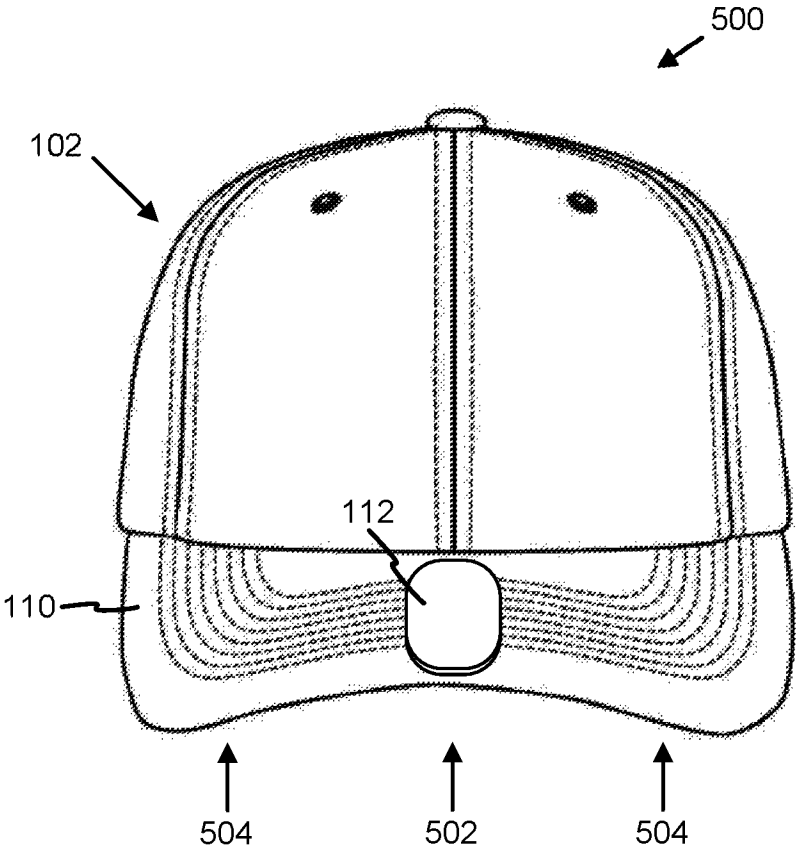
FIG. 5A is a front view illustrating one embodiment of a fishing hat apparatus.

FIG. 5A and FIG. 5B depict embodiments of an apparatus 500. The apparatus 500 may include features similar to those of the apparatus 100, the apparatus 200, or the apparatus 300 as explained above. As depicted in FIG. 5A, in some embodiments, the strip 112 may be disposed in a centered position 502 on the bill 110. The strip 112 being disposed in a centered position 502 may allow a wearer of the apparatus 500 to access the strip 112 (for example, to place or retrieve a hook in the strip 112) equally comfortably with either hand. This may be useful in response to the wearer having one hand occupied, for example, with a fishing rod.

As depicted in FIG. 5B, in one embodiment, the strip 112 may be disposed in a non-centered position 504 on the bill 110. For example, in one embodiment, the strip 112 may be disposed on the bill 110 on a side portion of the bill 110. The strip 112 being disposed on a non-centered position 504 on the bill 110 may allow a wearer of the apparatus 500 to place a hook, lure, or the like in the strip 112 more comfortably and with more convenient access than the strip 112 being disposed in other areas of the bill 110.

In one embodiment, the strip 112 may include a first strip, and the apparatus 500 may include a second strip of pliant, resilient material coupled to the bill 110. The apparatus 100 including two or more strips 112 may allow a wearer to attach more hooks, lures, or the like to the apparatus 100. In some embodiments, the two or more strips 112 may be disposed in various positions on the bill 110. For example, a first strip may be disposed on a first non-centered portion 504 of the bill 110, and a second strip may be disposed on a second non-centered portion 504 of the bill 110. In another embodiment, the first strip may be disposed on a first non-centered portion 504 of the bill 110, and the second strip may be disposed on the first non-centered position 504 of the bill 110 of an underside of the bill 110.

Figure 6:
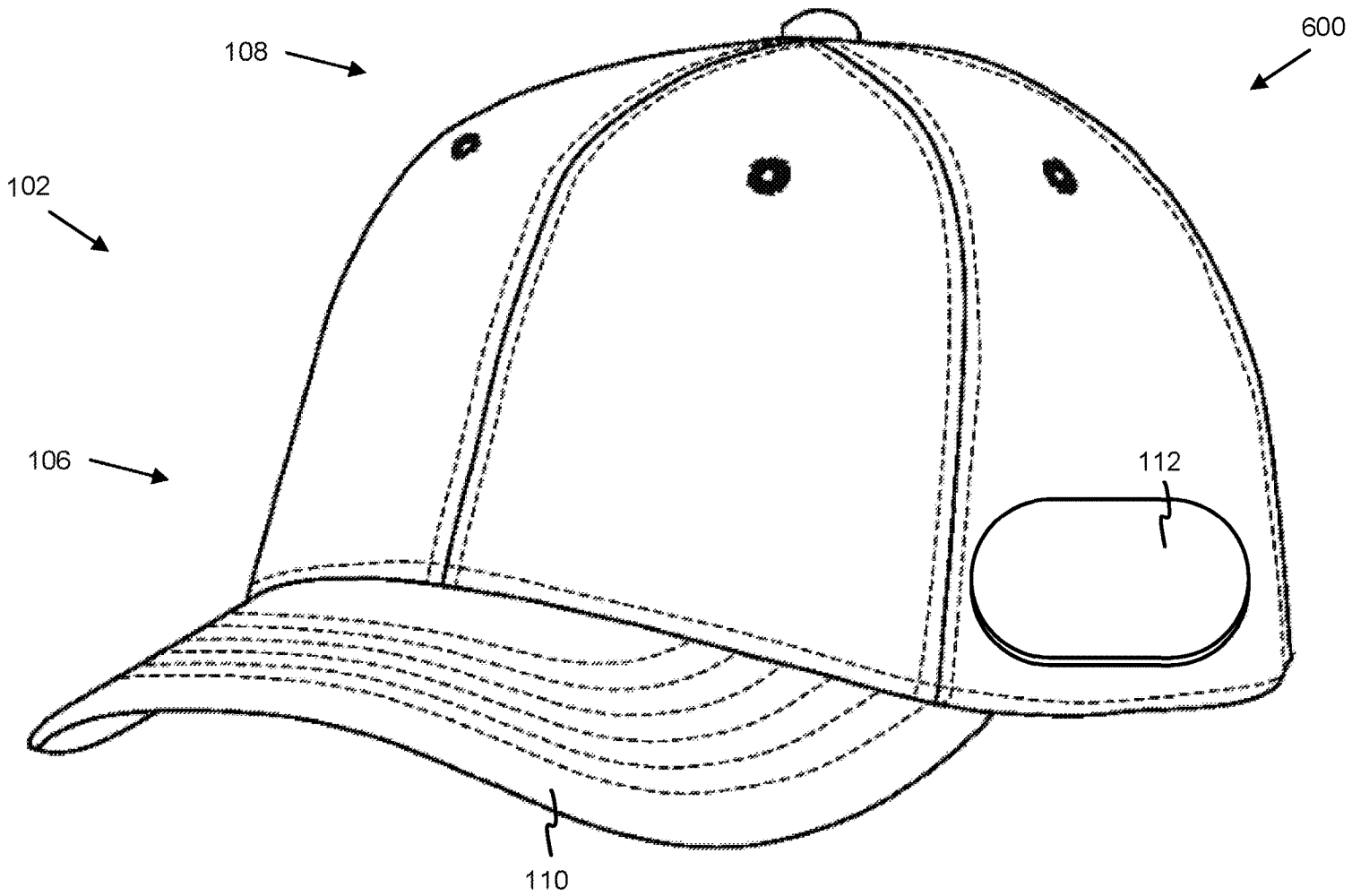
FIG. 6 is a perspective view illustrating one embodiment of a fishing hat apparatus.

FIG. 6 depicts one embodiment of an apparatus 600. The apparatus 600 may include features similar to those of the apparatus 100, the apparatus 200, the apparatus 300, or the apparatus 500 as described above. In one embodiment, the strip 112 may be disposed on the crown 102. The strip 112 may be disposed on various locations of the crown 102. The strip 112 may be disposed on a lower portion 106 of the crown 102. The strip 112 may be disposed on an upper portion 108 of the crown 102. The strip 112 may be disposed on a side portion of the crown 102 as shown in FIG. 6. The strip 112 may be disposed on a front portion of the crown 102 or a back portion of the crown 102. The strip 112 being disposed on the crown 102 may include the strip 112 being coupled to the crown 102. The strip 112 may couple to the crown 102 in a variety of ways, including as explained above in relation to FIG. 2A, FIG. 2B, and FIG. 2C in relation to the strip 112 being coupled to the bill 110. In some embodiments, the apparatus 600 may include two or more strips 112. A first strip 112 of the two or more strips 112 may be disposed on the crown 102 and a second strip 112 of the two or more strips 112 may be disposed on the bill 110.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:
a hat, comprising
a crown, and
a bill coupled to the crown, wherein the bill protrudes away from the crown; and
a strip of closed-cell foam, wherein
the strip comprises at least one groove integrally formed in the strip, wherein the strip is operable to receive a fishing hook and selectably couple the fishing hook to the strip, and
the strip is coupled to the crown of the hat.

2. The apparatus of claim 1, wherein the closed-cell foam comprises a polymeric foam.

3. The apparatus of claim 1, wherein the strip comprises a rectangular shape.

4. The apparatus of claim 1, wherein the at least one groove formed in the strip comprises a plurality of grooves formed in the strip.

5. The apparatus of claim 1:
wherein the strip comprises a first strip; and
further comprising a second strip of closed-cell foam coupled to the hat.

6. The apparatus of claim 1, wherein the strip being coupled to the crown of the hat comprises the strip being at least one of:
inserted into the crown of the hat;
sewn to the crown of the hat; or
glued to the crown of the hat.

7. The apparatus of claim 1, wherein the strip being coupled to the crown of the hat comprises the strip being integrated into the hat.

8. The apparatus of claim 1, wherein the strip is disposed in a non-centered position on the front of the crown.

9. The apparatus of claim 1, wherein the strip is disposed in a central position on the front of the crown.

10. The apparatus of claim 1, wherein the strip is disposed on the crown and above the bill.

11. An apparatus, comprising:
a hat, comprising
a crown, and
a bill coupled to the crown, wherein the bill protrudes away from the crown; and
a strip of closed-cell foam, wherein
the strip comprises a plurality of grooves formed on the strip, wherein each groove of the plurality of grooves is operable to receive a fishing hook and selectably couple the fishing hook to the strip, and
the strip is coupled to the crown of the hat.

12. The apparatus of claim 11:
wherein the strip comprises a first strip; and
further comprising a second strip, wherein the second strip is disposed on the hat.

13. The apparatus of claim 11, wherein the strip being coupled to the crown of the hat comprises the strip being at least one of:
inserted into the crown of the hat;
being sewn to the crown of the hat; or
being glued to the crown of the hat.

14. The apparatus of claim 11, wherein the strip is disposed on the crown of the hat.

15. The apparatus of claim 14, wherein the strip is disposed in a non-centered position on the front of the crown.

16. The apparatus of claim 14, wherein the strip is disposed on a centered position on the front of the crown.

17. The apparatus of claim 14, wherein the strip is disposed on the crown and above the bill.

18. A hat comprising:
a crown, comprising a plurality of pieces of material, wherein at least a portion of the pieces of material are coupled to each other, and wherein the plurality of pieces form a dome adapted to fit over the head of a person;
a bill coupled to the crown on a front side of the crown, wherein
the front side of the crown is disposed opposite the rear side of the crown, and
the bill protrudes away from the crown; and
a strip of closed-cell foam disposed on a centered portion of the front side of the crown, wherein the strip comprises
a base coupled to the front side of the crown,
at least one protrusion disposed on and extending away from the base and extending away from the bill, and
at least one groove formed in the strip, wherein the sides of the groove are formed from at least a portion of the plurality of protrusions.

* * * * *